US005859382A

United States Patent [19]

Funaki

[11] Patent Number: 5,859,382

[45] Date of Patent: Jan. 12, 1999

[54] SYSTEM AND METHOD FOR SUPPORTING AN ADLIB PERFORMANCE

[75] Inventor: Tomoyuki Funaki, Hamamatsu, Japan

[73] Assignee: Yamaha Corporation, Japan

[21] Appl. No.: 837,847

[22] Filed: Apr. 22, 1997

[30] Foreign Application Priority Data

Apr. 25, 1996 [JP] Japan ..... 8-129087

[51] Int. Cl.[6] ..... G10H 1/38; G10H 7/00

[52] U.S. Cl. ..... 84/637; 84/613; 84/619; 84/477 R

[58] Field of Search ..... 84/613, 616, 619, 84/637, 654, 657, 477 R

[56] References Cited

U.S. PATENT DOCUMENTS 4,876,938 10/1989 Shinohara ..... 84/613 X 5,656,789 8/1997 Nakada et al. ..... 84/477 R

*Primary Examiner*—Jonathan Wysocki

*Assistant Examiner*—Jeffrey W. Donels

*Attorney, Agent, or Firm*—Graham & James LLP

[57] ABSTRACT

A plurality of display units are provided in corresponding relations to individual performance keys. A table stores, for each of a plurality of chords, information which defines plural groups of notes that are always available for the chord, temporarily available (e. g., a tension note) for the chord and unavailable for the chord. In response to designation of a chord according to a chord progression, the information is read out from the table and the display units are controlled according to the read-out information so as to dislay in different forms, depending on which one of the groups the performance keys corresponding to the display units correspond to. A performer can operate a desired key in consideration of different display forms. Thus, there is provided a music performance assisting system which is suited for use in executing an adlib performance with notes well conforming to a designated chord.

21 Claims, 9 Drawing Sheets

| INTERVAL (DEGREE) | FUNCTION CODE | CHORD NAME IN C MAJOR | CHORD COMPONENT NOTE & TENSION NOTE | AVAILABLE NOTE SCALE |
|---|---|---|---|---|
| I<br>IΔ<br>I6<br>IM7 | T | C<br>CΔ<br>C6<br>CM7 | (♮9) | IONIAN |
| | | | (#11<br>♮9) | LYDIAN |
| IIm7 | S | Dm7 | (♮11<br>♮9) | DORIAN |
| IIIm7 | T | Em7 | (♮11) | PHRYGIAN |
| IV<br>IVΔ<br>IV6<br>IVM7 | S | F<br>FΔ<br>F6<br>FM7 | (#11<br>♮9) | LYDIAN |
| V7 | D | G7 | (♮13<br>♮9) | MIXOLYDIAN |
| | | | (♮13<br>#11<br>♮9) | LYDIAN b7 |
| | | | (b13<br>b9) | HARMONIC MINOR P5↓ |
| | | | (b13<br>#11<br>b9,#9) | ALTERED DOMINANT |
| | | | (♮13<br>#11<br>b9,#9) | COMBINATION DIMINISHED |
| | | | (#11<br>♮9) | WHOLE TONE |
| VIm7 | T | Am7 | (♮11<br>♮9) | AEOLIAN |
| (b5)<br>VIIm7 | D | (b5)<br>Bm7 | (b13<br>♮11) | LOCRIAN |

FIG. 2

| INTERVAL (DEGREE) | FUNCTION CODE | CHORD NAME IN C MINOR | CHORD COMPONENT NOTE & TENSION NOTE | AVAILABLE NOTE SCALE |
|---|---|---|---|---|
| Im<br>ImΔ<br>Im6<br>Im7<br>IM7 | T | Cm<br>CmΔ<br>Cm6<br>Cm7<br>CM7 | (♮11 ♮9) | TONIC MINOR |
| Im7 | T | Cm7 | (♮11 ♮9) | DORIAN |
| (b5)<br>IIm7 | SM | (b5)<br>Dm7 | (b13 ♮11) | LOCRIAN |
| IIm7 | S | Dm7 | (♮11) | DORIAN b2 |
| bIIIm7<br>(bIII6) | T | E bM7<br>(E b6) | (♮9) | IONIAN |
| | | | (#11 ♮9) | LYDIAN |
| IVm<br>IVmΔ<br>IVm6<br>IVm7 | SM | Fm<br>FmΔ<br>Fm6<br>Fm7 | (♮11 ♮9) | DORIAN |
| IV7 | S | F7 | (♮13 #11 ♮9) | LYDIAN b7 |
| V7 | D | G7 | SAME HARMONIC MINOR P5↓, ALTERED DOMINANT, CONBINATION DIMINISHED & WHOLE TONE AS FOR V7 OF FIG. 2 | |
| Vm7 | D | Gm7 | (♮11) | PHRYGIAN |
| bVIM7<br>(bVI6) | SM | A bM7<br>(A b6) | (#11 ♮9) | LYDIAN |
| (b5)<br>VIm7 | T | (b5)<br>Am7 | (b13 ♮11) | LOCRIAN #2 ( ALTERED DORIAN ) |
| | | | | LOCRIAN |
| bVII7 | SM | B b7 | (♮13 ♮9) | MIXOLYDIAN |

FIG. 3

SYSTEM AND METHOD FOR SUPPORTING AN ADLIB PERFORMANCE

BACKGROUND OF THE INVENTION

The present invention relates generally to a music performance assisting technique of illuminating visual display units corresponding to keys to be operated so as to provide a visual guide for a player's manual performance, and more particularly to a music performance assisting system which is suited for use in executing an adlib performance with pitches well conforming to a designated chord or the like.

Electronic musical instruments, such as electronic pianos, have been widely used in recent years on which a player can play a desired melody with a background automatic performance. Among various examples of such known electronic pianos are ones provided with a "music performance assisting system" which typically includes luminous visual display units, such as light emitting diodes, provided in corresponding relations to individual keys on the keyboard and where predetermined ones of the visual display units for the keys to be depressed in a desired melody performance are sequentially turned on or lit in accordance with progression of an automatic performance. With such a music performance assisting system, the desired melody performance can be executed accurately by just depressing one key after another as visually designated by the lighting of the corresponding display units.

However, the conventionally known performance assisting systems are completely useless or unsatisfactory when used in performing a melody adlib rather than in a predetermined manner. Further, in the adlib performance, it is important to accurately select tone pitches conforming to each designated chord or the like, but such an accurate pitch selection was very difficult to even considerably experienced players.

SUMMARY OF THE INVENTION

It is therefore an object of the present invention to provide a music performance assisting system which is suited for use in executing an adlib performance with pitches well conforming to a designated chord or the like.

In order to accomplish the above-mentioned object, a first aspect of the present invention provides a music performance assisting system which comprises: a performance operator section including a plurality of performance operating members corresponding to different tone pitches; a display section including a plurality of display units provided in corresponding relations to said performance operating members; a chord designation section which designates a chord varying with a desired chord progression; a determination section which determines, in response to the chord designated by said chord designation section, at least two groups of tone pitches that are always available for the chord and temporarily available for the chord, respectively; and a display control section which performs control to allow respective forms of display of said display units to differ from each other, depending on whether or not said performance operating members corresponding to said display units correspond to one of the two groups of tone pitches determined by said determination section and which one of the two groups of tone pitches said performance operating members correspond to.

Once a particular chord is designated by the designation section, the display control section allows the display units, which correspond to the individual performance operating members of the performance operator section, to operate in different forms of display, depending on whether or not the operating members correspond to one of the groups of tone pitches by the determination section for the chord and which one of the groups of tone pitches the performance operating members correspond to. Due to the different forms of display of the display units, the player can readily or at a glance distinguish among always available tone pitches (e.g., chord notes), temporarily available tone pitches (e. g., a non-chord tension note) and other tone pitches (e. g., a simple non-chord note) for the designated chord. As a result, the player is allowed to execute an adlib performance, without substantially departing from the designated chord etc. i.e., with tone pitches well conforming to the designated chord, such as by mainly selecting and performing the always available tone pitches and promptly getting back to these keys if the player has selected any of the temporarily available tone pitches (e. g., a tension note).

A second aspect of the present invention provides a music performance assisting system which comprises: a performance operator section including a plurality of performance operating members corresponding to different tone pitches; a display section including a plurality of display units provided in corresponding relations to said performance operating members; a supply section which supplies automatic performance information containing at least chord information for designating a chord varying with a predeteremined chord progression; a determination section which determines, in response to the chord designated by said chord information, at least two groups of tone pitches that are always available for the chord and temporarily available for the chord, respectively; a detection section which detects respective frequencies of use of tone pitches in the automatic performance information supplied by said supply section for each chord section where one chord is designated by said chord information; and a display control section which performs control to allow respective forms of display of said display units to differ from each other, depending on whether or not said performance operating members corrsponding to said display units correspond to one of the two groups of tone pitches and which one of the two groups of tone pitches said performance operating members correspond to, and also in accordance with the frequencies of use detected by said detection section for the tone pitches of the same group.

In the music performance assisting system according to the second aspect, the detection section detects the respective frequencies of use of tone pitches in the automatic performance information supplied by the supply section for each chord section where one chord is designated by the chord information in the automatic performance information. Thus, in addition to the control as mentioned in relation to the first aspect, the display control section performs controls the forms of display of the display units corresponding to the tone pitches of the same group to differ from each other in accordance with the frequencies of use detected by the detection device. Due to such different forms of display of the display units, the player can not only readily distinguish among always available tone pitches, temporarily available tone pitches and other tone pitches for the designated chord, but also readily recognize the respective frequencies of use of tone pitches in the automatic performance information even if they are of the same group (i.e., irrespective of whether they are always available tone pitches, or temporarily available tone pitches).

Thus, by intentionally selecting the less-frequently used tone pitches more often, it is possible to achieve an even more sophisticated adlib performance with good musical balance with an automatic performance.

In the above-mentioned music performance assisting systems according to first and second aspects, a plurality of arrays or groups of display units may be provided in corresponding relations to the individual performance operating members and control may be performed such that one of the display unit arrays gives a visual display of a current chord designated by said chord designation section and the one or more other display unit arrays give a visual display of a next chord which is designated by said chord designation section after the current chord. In this case, the player can select tone pitches suitable for the current chord on the basis of the display form of the one display unit array and also know in advance tone pitches suitable for the next chord on the basis of the display form of the other display unit arrays. As a result, the player is allowed to promptly and accurately select tone pitches when the performance moves to a next chord.

Further, in the case where a plurality of arrays or groups of the display units are provided, the display control section may perform further control to allow the forms of display to differ between the first array and the other arrays. In this way, it is possible to minimize the possibility of the player confusing the visual display for the current chord with that for the next chord, to thereby achieve an even more accurate selection of tone pitches.

Furthermore, in such a case where a plurality of arrays or groups of the display units are provided, the display control section may perform further control to vary the form of display of at least one of the arrays of the display units in accordance with a progression of time. Thus, the player is allowed to readily recognize the timing when the performance chord varys from the current chord to the next chord. This greatly contributes to an even more prompt selection of tone pitches when the next chord is started.

Moreover, in such a case where a plurality of arrays or groups of the display units are provided, each time the chord designated by said chord designation section varys from one to another, a fixed one of the display unit arrays may always be controlled to give a display for a current chord and the other of the display unit arrays may always be controlled to give a display for a next chord. Thus, even when the chord varys, the positional relationship can be fixed between the display units of one array giving a display for the current chord and the display units of another array giving a display for the next chord, so that the player can judge tone pitches conforming to the current and next chords with utmost ease.

BRIEF DESCRIPTION OF THE DRAWINGS

For better understanding of the present invention, the preferred embodiments of the invention will be described in detail below with reference to the accompanying drawings, in which:

FIG. 2 is a diagram showing exemplary contents of an available note scale table;

FIG. 3 is a diagram showing exemplary contents of another available note scale table;

DETAILED DESCRIPTION OF THE PREFERRED EMBODIMENTS

Figure 1:
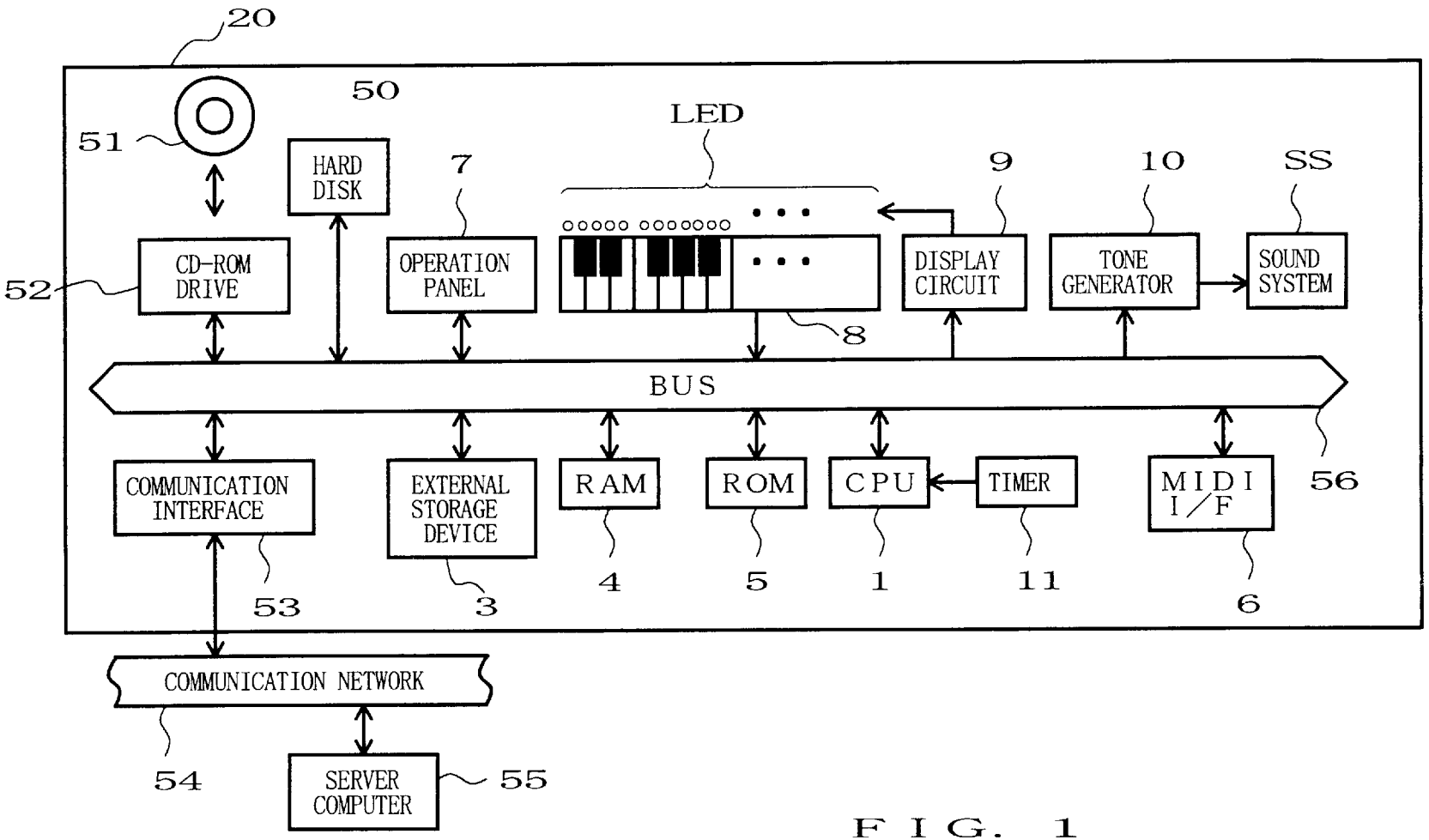
FIG. 1 is a block diagram illustrating a general hardware setup of an electronic musical instrument incorporating therein a music performance assisting system according to an embodiment of the present invention.

FIG. 1 is a block diagram illustrating a general hardware setup of an electronic musical instrument 20 incorporating therein a music performance assisting system according to an embodiment of the present invention. A CPU 1 controlling overall operations of the electronic musical instrument 20 is connected, via a bus 2, an external storage device 3, a RAM 4, a ROM 5, a MIDI interface 6, an operation panel (including operating switches and a central display) 7, a keyboard 8, a display circuit 9 and a tone generator 10. From a timer 11, the CPU 1 receives clock pulses which are used as tempo clock pulses to activate a later-described interrupt process.

To the external storage device 3 is detachably attached a recording medium having stored therein automatic performance data of a particular music piece including pitch information, tone generation controlling information and timing information from the start to end of the music piece. The thus-attached recording medium can be driven by the external storage device 3, which in this embodiment is an optical disk device.

The RAM 4 includes areas for temporarily storing automatic performance data read out from the recording medium via the external storage device 3, areas for storing various other data and areas for use as flags, registers etc. In the ROM 5, there are prestored a "chord table" and "available note scale tables" in addition to programs descriptive of various operations to be executed by the CPU 1.

In the "chord table", there are stored chords (chord roots and chord types) and tone pitches of component notes of each of the chords, in corresponding relations to each other.

In each of the "available note scale tables", there are stored chords and tone pitches available to the individual chords (available note scales), in corresponding relations to each other. Examples of the available note scale table are illustrated in FIGS. 2 and 3. In each of these examples, tone pitches available to diatonic chords are shown as classified on the basis of the tonic (or keynote) of a musical key, and FIGS. 2 and 3 illustrate available note scale tables corresponding to major and minor keys. For a C major chord (C, C6 and CM7) with note name C as its root, for example, it may be seen from FIG. 2 that the available notes are pitches of note names C, E, G, A and B (each denoted in whole tone), pitch of note name D that is a non-chord tension note (denoted in black dot), and pitch of note name F that is neither a tension note nor a non-chord note (denoted in black triangular dot). It should be appreciated that note name A becomes a chord component note of a sixth chord (C6 chord) and note name B becomes a chord component note of a major seventh chord (CM7 chord) but these note names become non-chord component notes (available) of other chords (e.g., C chord).

Where two or more combinations of available pitches exist for a same chord as is the case with the chord classified as first degree or the chord classified as fift degree in FIG. 2, only one of the pitch combinations may be stored in the available note scale table, or all these pitch combinations may be stored in the available note scale table to allow the player to select desired pitch data therefrom through his or her selection operation on the operation panel 7. Alternatively, one of the pitch combinations may be designated by the CPU 1 in accordance with a progression of a music piece, or by data designating a particular pitch combination may be recorded, along with automatic performance data, on a recording medium to be attached to the external recording device 3.

According to the embodiment, the available note scale tables are provided only for C major and C minor; in case of a change in the tonic of the key, the C key scale only has to be shifted in accordance with the C key tonic and musical intervals. However, in an alternative, various different scales corresponding to all possible tonics may be stored.

Although not specifically shown, the operation panel 7 in FIG. 1 includes various switches, such as those for setting various conditions (e.g., tone color and effect) in executing a performance and start/stop switch for selectively starting or stopping an automatic performance.

An array of paired light emitting diodes LED are provided along and close to the keyboard 8, with the pairs of the diodes corresponding to the individual keys, one pair for each key. Each pair of the diodes (or display unit) for each individual key comprises a plurality of light emitting diodes of different colors (in the illustrated example, a pair of red and green light emitting diodes).

Under the control of the CPU 1, the display circuit 9 is capable of, for each of the pairs, turning on a selected one of the red and green light emitting diodes by applying thereto continuous or pulsed voltage, and also capable of optionally setting the brightness of the selected diode by adjusting the magnitude of the applied voltage.

MIDI message created on the basis of data read out from a recording medium via the external storage device 3 and MIDI message created in response to the player actually executing a performance on the keyboard 8 are supplied to the tone generator 10 via different MIDI channels. The tone generator 10 executes tone waveform forming processing according to these MIDI messages in a parallel fashion and mixes the generated tone waveform data, so that the thus-mixed tone waveform data is delivered to a sound system SS. This way, the melody performed by the player is audibly reproduced or sounded with the background automatic performance.

Next, control of the electronic musical instrument by the CPU 1 will be described centering on on control of two arrays of the light emitting diodes LED1 and LED 2.

Figure 4:
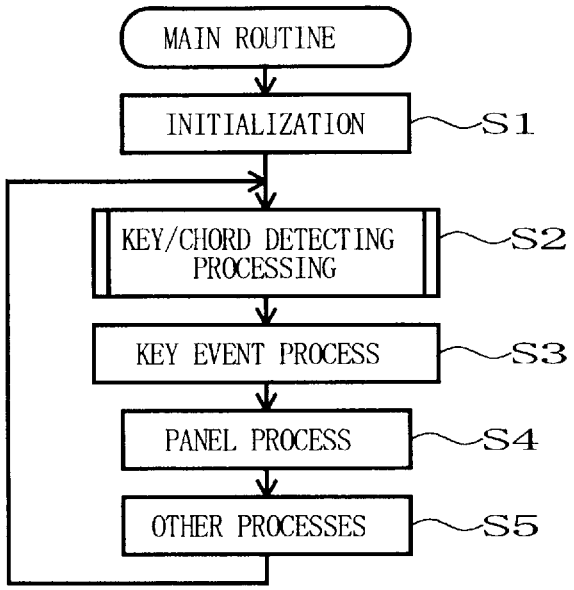
FIG. 4 is a flowchart of a main routine executed by a CPU of FIG. 1.

FIG. 4 is a flowchart of a main routine executed by the CPU 1, where after predetermined initialization at step S1, "key/chord detecting processing" (step S2), "key event process" (step S3), "panel processing" (step S4) and "other processes" (step S5) are executed repetitively in a steady loop.

Figure 5:
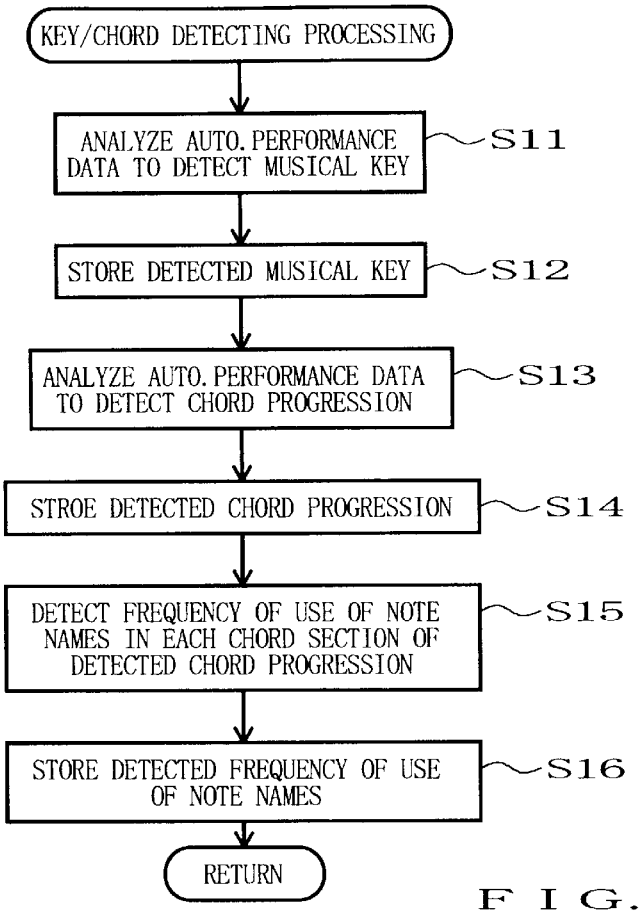
FIG. 5 is a flowchart showing an example of key/chord detecting processing of FIG. 4.

The musical key/chord detecting processing is executed to detect a musical key and chord progression of a music piece as a preliminary to actually performing the music piece. In this musical key/chord detecting processing, as shown in FIG. 5, automatic performance data are read out from the recording medium attached to the external storage device 3 and then analyzed to detect a musical key of the music piece (step S11). Then, data indicative of the detected key (i.e., tonic and major or minor key) is stored into the RAM 4 at step S12, and data indicative of chords (chord roots and chord types) for individual sections in the chord progression (chord sections) is stored into the RAM 4 at step S14. After this, for each of the sections in the chord progression, a detection is made of frequency of use of the individual note names in the automatic performance data at step S15, and data indicative of the detected frequency of use of the individual note names is stored into the RAM 4 at step S16. Then, control returns to the main routine.

Figure 6:
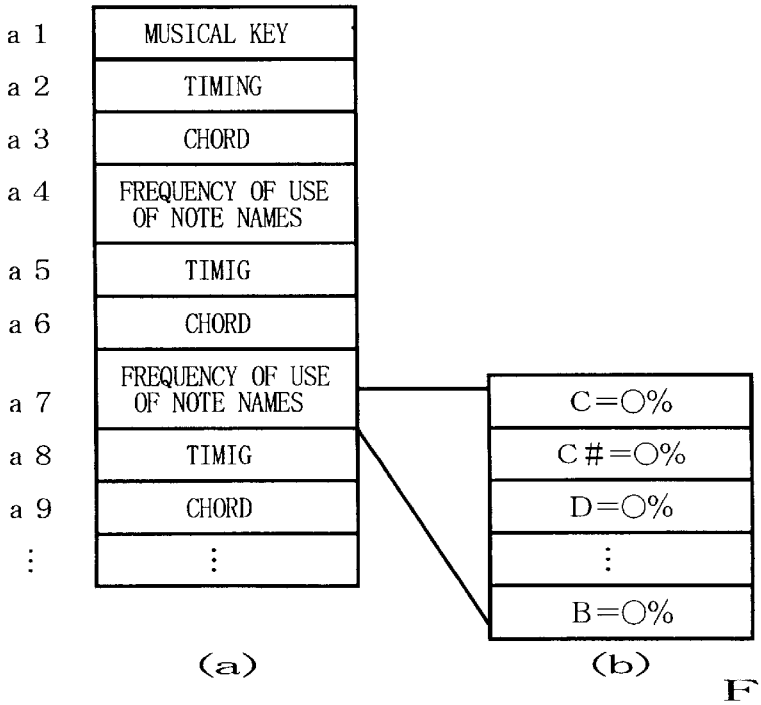
FIGS. 6A and 6B are diagrams showing an exemplary storage format of data detected by the key/chord detecting processing.

FIG. 6 shows an exemplary storage format, in the RAM 4, of various data detected by this musical key/chord detecting processing. As shown in block (a) of FIG. 6, musical key data is stored at head address a1, and sets of timing data, chord data and frequency-of-use-of-note-name data of the individual chord sections are stored at the following addresses a2, a3, . . . an.

The timing data indicates a time interval between start timing in a current chord section and start timing in a preceding chord section (in the case of timing data of the first chord section, a time interval between start timing in the current chord section and start timing of the music piece), in terms of the number of clock pulses each corresponding to a minimum note resolution (e.g., 96th note) of the electronic musical instrument.

As shown in block (b) of FIG. 6, the frequency-of-use-of-note-name data indicates, in percentage, the frequency of use of the individual note names in the chord section. Note that because there may be a change of musical key in some music pieces, such a musical key change may also be detected at step S11 so that data indicative of the musical key and the time point of the musical key change may be stored into the RAM 14 at step S12.

Figure 7:
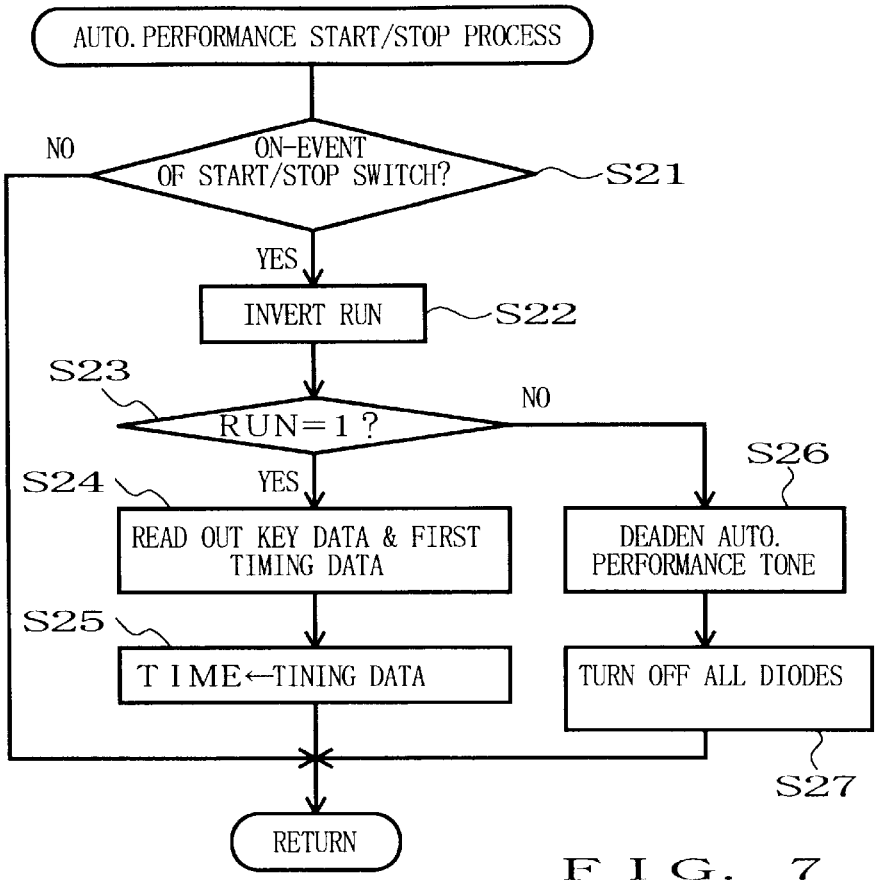
FIG. 7 is a flowchart of an automatic performance start/stop process in panel processing of FIG. 4.

Referring back to FIG. 4, the key event process executes well-known tone generating and tone deadening processes on the basis of key-on and key-off events occurring on the keyboard 8. The panel processing is executed in response to activation of any of the switches on the operation panel 7 FIG. 7 is a flowchart of an automatic performance start/stop process in the panel processing which is executed in response to activation of the above-mentioned start/stop switch. In this automatic performance start/stop process, a determination is first made, at step S21, as to whether there has occurred an on-event of the start/stop switch. With a negative answer, control returns to the main routine. But, with an affirmative answer, a value set in automatic performance flag RUN is inverted between "1" and "0" at step S22, and it is further determined at step S23 whether or not the inverted value of the automatic performance flag RUN is "1".

If the inverted value of the automatic performance flag RUN is "1" (YES), control proceeds to step S24 to read out the musical key data and first timing data (FIG. 6) previously stored in the RAM 4 by the above-mentioned musical key/chord detecting processing. Following this, the number of clock pulse indicated by the read-out timing data is set as "TIME" at step S25, and then control returns to the main routine. If the inverted value of the automatic performance flag RUN is not "1" (NO), control branches to step S26 in order to perform a predetermined tone-deadening process on each tone being automatically performed, and then to step S27 in order to turn off all the light emitting diodes.

Figure 8:
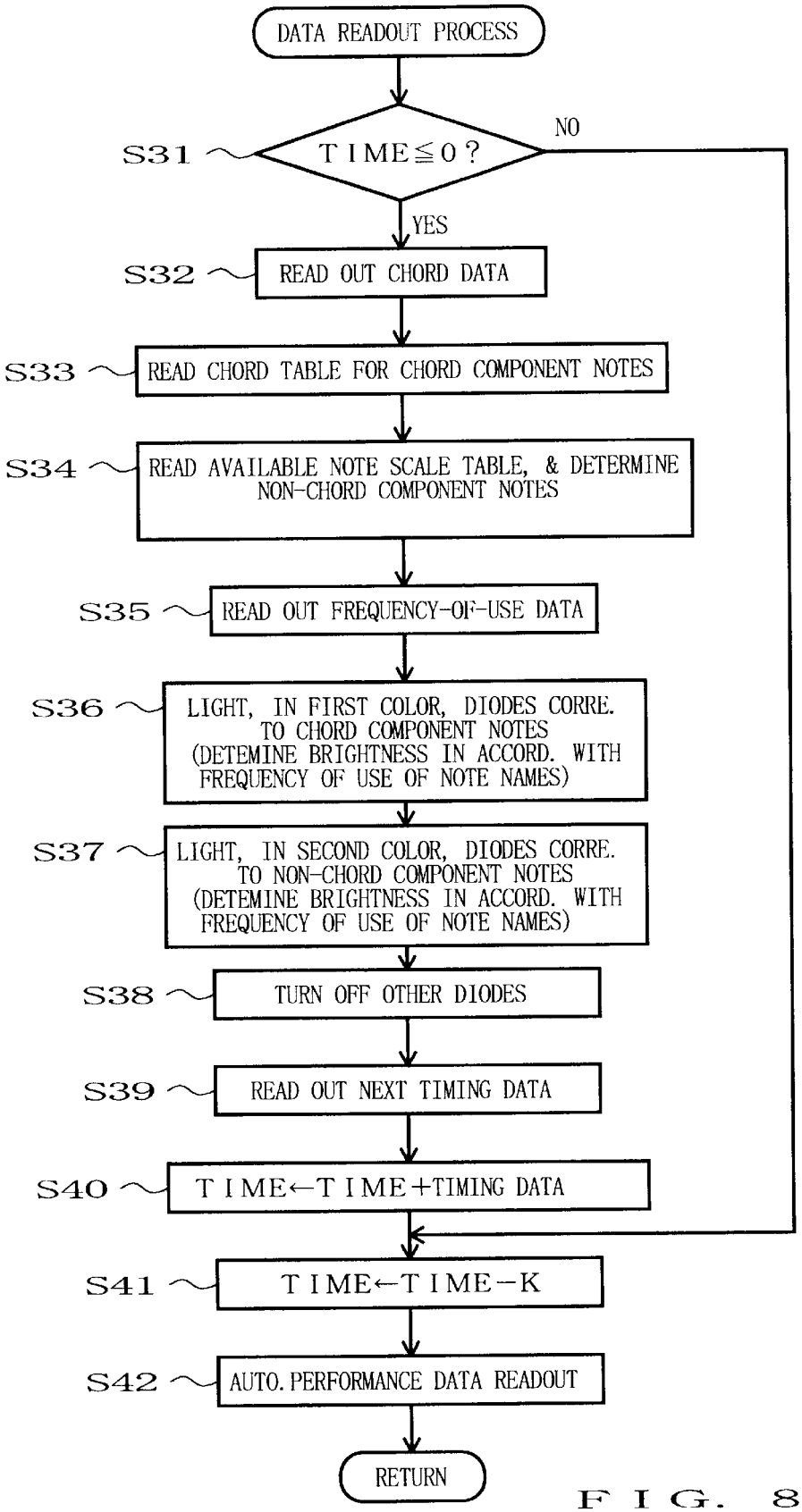
FIG. 8 is a flowchart showing an example of an interrupt process executed by the CPU.

Thus, when the start/stop switch is activated while the automatic performance flag RUN is at the value "1", the automatic performance flag RUN is inverted to the value "0". Conversely, when the start/stop switch is activated while the automatic performance flag RUN is at the value "0" (i.e., while an automatic performance is not being executed), the automatic performance flag RUN is inverted to the value "1", in response to which the CPU 1 executes an interrupt process as shown in FIG. 8 so as to control the lighting condition of the light emitting diodes and execute an automatic performance.

Data readout process is an interrupt process that is triggered at predetermined processing intervals (e.g., every 10 m.s.). In this data readout process, a determination is first made at step S31 as to whether the number of clock pulse TIME is equal to or smaller than "0". At an initial stage, the number of clock pulse TIME remains set to the one indicated by the timing data of the first chord section, and thus a negative determination results at step S31, so that control goes to step S41. At step S41, the number of clock pulse K corresponding to the processing interval (in this example, 10 m.s.) of the data readout process is subtracted from the current number of clock pulse TIME and the subtraction results set as a new number of clock pulse TIME.

The number of clock pulse K is calculated from the following expression:

$$K=\text{tempo}\times\text{note resolution}\times\text{processing interval}/6\times1000$$

Here, the "tempo" is expressed by the number of quarter notes per minute, and the "note resolution" is expressed on the basis of resolution for a quarter note (24 if the minimum unit is a 96th note as earlier mentioned).

After step S41, control executes an automatic performance data readout process at step S42 and then returns to the main routine. The automatic performance data readout process is a well known process which reads out automatic performance data, recorded on a recording medium attached to the external storage device 3, progressively from the start of the music piece and creates MIDI messages on the basis of the read-out automatic performance data.

When the number of clock pulse indicated by the timing data of the first first chord section is "0", or once the number of clock pulse TIME has become less than "0" due to one or more executions of the data readout process, an affirmative determination results at step S31, so that control proceeds to step S32 so as to read out chord data for the same chord section containing the timing data that has been stored in the RAM 4 through the above-mentioned musical key/chord detecting processing.

At next step S33, tone pitches of chord component notes (available consonances) indicated by the read-out chord data are determined with reference to the "chord table" in the ROM 5. Then, at step S34, some of the available note scale tables in the ROM 5 are selected, depending on whether the musical key data read out in the automatic performance start/stop process is of a major key or minor key. After this, it is determined, on the basis of a difference from the tonic of the musical key, of which degrees (I , II , III , . . . ) are notes constituting the chord indicated by the chord data; then one available note scale table is selected from among those of the key; and then an available note scale in the selected available note scale table corresponding to the chord indicated by the chord data is shifted by an amount corresponding to a musical interval, from note name C, of a note name of the tonic indicated by the musical key data. If, for example, the musical key data represents B flat major and the chord data is Gm, the musical interval, from note name B♭ of the tonic of B flat major, of the root of the chord Gm is VI (sixth degree), so that "Aeolian" scale, sixth scale, is selected to be shifted by an amount corresponding to a musical interval between note name C and note name B♭ of the tonic of the musical key. Following this, tone pitches of the chord component notes determined at step S33 are removed from available tone pitches of the shifted available note scale so that the remaining available tone pitches are determined as those for passing tones that can be used temporarily. Next step S35 reads out frequency-of-use-of-note-name data for the same chord section containing the chord data that has been stored in the RAM 4 through the above-described musical key/chord detecting processing.

Then, at step S36, of the light emitting diodes for the keys corresponding to the tone pitches of the chord component notes determined at step S33, those of first color (e.g., red) are turned on. Also, depending on the frequency of use of note names indicated by the frequency-of-use-of-note-name data read out at step S35, control is performed such that the brightness of the first-color light emitting diodes for the keys corresponding to more frequently used note names is lower than that of the other first-color light emitting diodes for the keys corresponding to less frequently used note names.

Then, at step S37, of the light emitting diodes for the keys corresponding to the tone pitches of the available non-chord component notes determined at step S34, those of second color (e.g., green) are turned on. Also, depending on the frequency of use of note names indicated by the frequency-of-use-of-note-name data read out at step S35, control is performed such that the brightness of the second-color light emitting diodes for the keys corresponding to more frequently used note names is lower than that of the other second-color light emitting diodes for the keys corresponding to less frequently used note names.

Following step S38 turns off all the light emitting diodes other than those previously turned on at steps S36 and S37 (i.e., those for the keys corresponding to tone pitches of non-available dissonances).

Next step S39 reads out, from the RAM 4, timing data of the following chord section (at the initial stage, the timing data of the chord section following the first chord section is read out). At next step S40, the number of clock pulse indicated by the timing data is added to the current number of clock pulse TIME, and the resultant sum is set as a new number of clock pulse TIME. Then, after execution of the operations of steps S41 and S42 as described above, control returns to the main routine.

Each time the performance moves to a new chord section, the light emitting diodes, for the keys corresponding to tone pitches available for the new chord section (i.e., tone pitches of the chord component notes) and keys corresponding to tone pitches temporarily available for the new chord section (i.e., tone pitches of available non-chord notes), are turned on or lit in red and green, by repetitive execution of the above-described data readout process. Thus, by referring to the operating states of the light emitting diodes, the player can readily (or at a glance) distinguish among the always available and temporarily available tone pitches and other tone pitches for the chord section. By depressing a proper key or keys while being guided by a illuminated color of a corresponding light emitting diode, the player is allowed to execute an adlib performance without substantially departing from a designated key and chords, such as by mainly depressing the keys associated with the light emitting diodes lit in red and promptly getting back to these keys if the player has depressed a key associated with the diode lit in green.

Further, because the brightness is allowed to differ among the diodes depending on the frequency of use of tone pinches of automatic performance data for the chord section, the player can recognize at a glance that frequency of use of the tone pinches. Also, by, for example, depressing the keys associated with the light emitting diodes lit with higher brightness more frequently, it is possible to supplement, via adlib performance, tones that are rarely produced from automatic performance, so as to achieve an even more sophisticated adlib performance with good musical balance.

In one preferred form of the invention, the brightness of the light emitting diodes for the keys actually depressed by the player may be progressively reduced so that total frequency of use of tone pitches designated by automatic performance data and by the player are readily identified whenever necessary. Further, when a change of musical key (modulation) during a music piece performance was detected and data indicative of the modulation was stored in the RAM 4, the modulation data may be read out at step S32 as needed.

Figure 9:
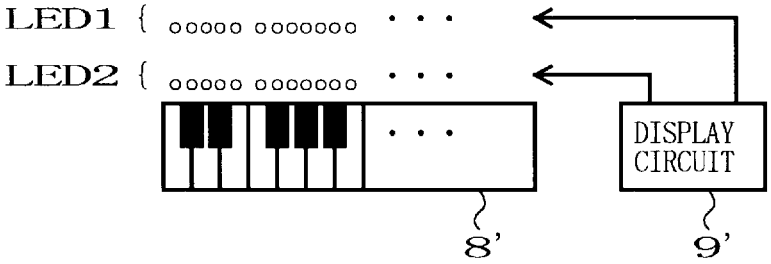
FIG. 9 is a diagram showing a modified keyboard and two arrays of light emitting diodes provided along and close to the keyboard.

Next, a description will be made about a modification of the above-described embodiment, with reference to FIG. 9 and subsequent figures.

This modified music performance assisting system is incorporated in an electronic musical instrument, which is similar to that of FIG. 1, but two arrays of paired light emitting diodes LED1 and LED2 are provided along and close to a keyboard 8' of the electronic musical instrument, with pairs of the diodes corresponding to the individual keys. In each of the arrays LED1 and LED2, each pair of the diodes for one key comprises red and green light emitting diodes, as in the electronic musical instrument of FIG. 1.

Under the control of the CPU 1, a display circuit 9 is capable of, for each of the pairs, turning on a selected one of the red and green light emitting diodes in each of the arrays by applying thereto continuous or pulsed voltage, and also capable of optionally setting the brightness of the selected diode by adjusting the magnitude of the applied voltage.

When automatic performance flag RUN is inverted from "1" to "0" in the modified music performance assisting system, an "automatic performance start/stop process" turns off all the light emitting diodes in the two arrays LED1 and LED2 at a step corresponding to step S27 of the automatic performance start/stop process described earlier in relation to FIG. 7.

Figure 10:
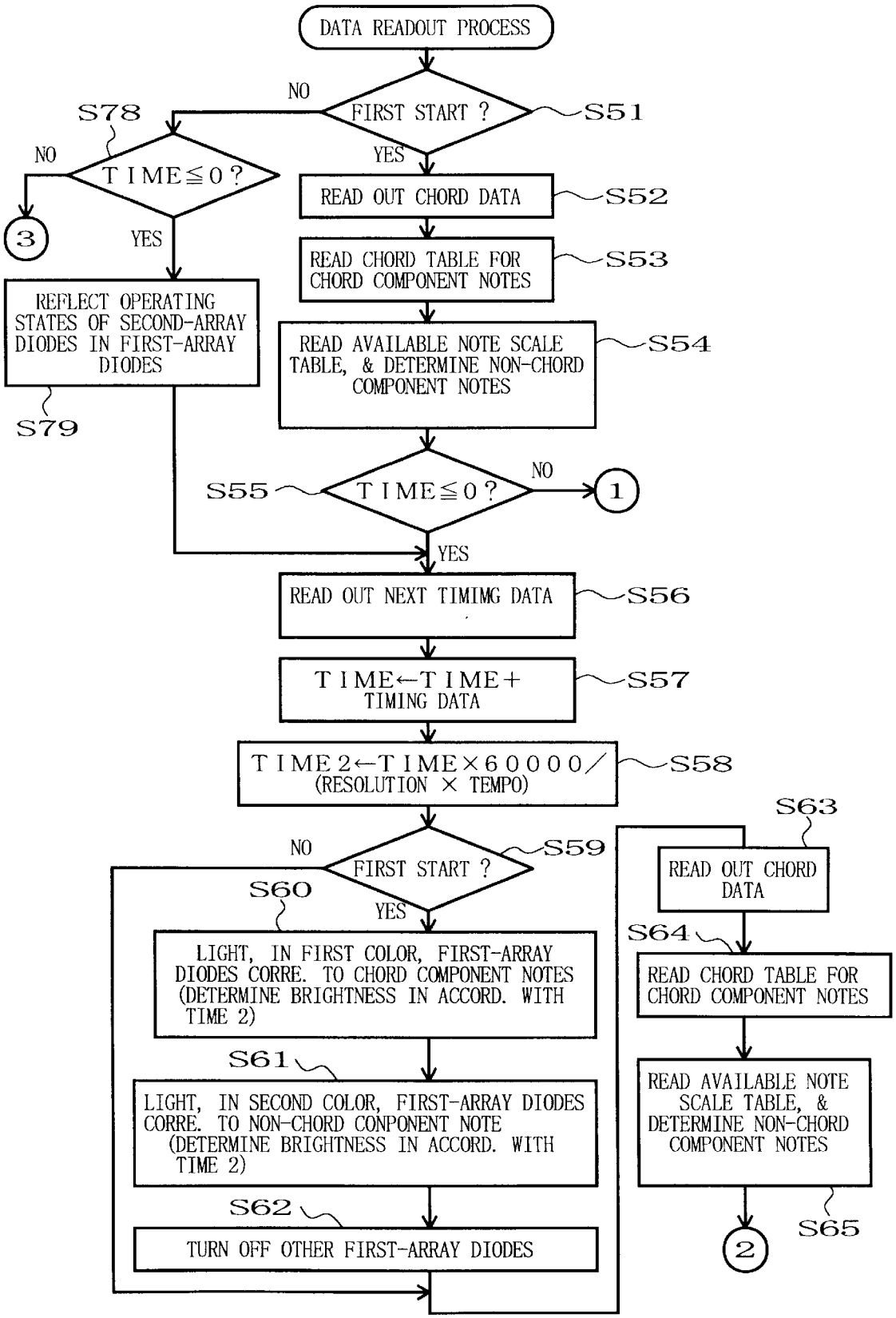
FIG. 10 is a flowchart showing a portion of a modification of the interrupt process executed by the CPU.
Figure 11:
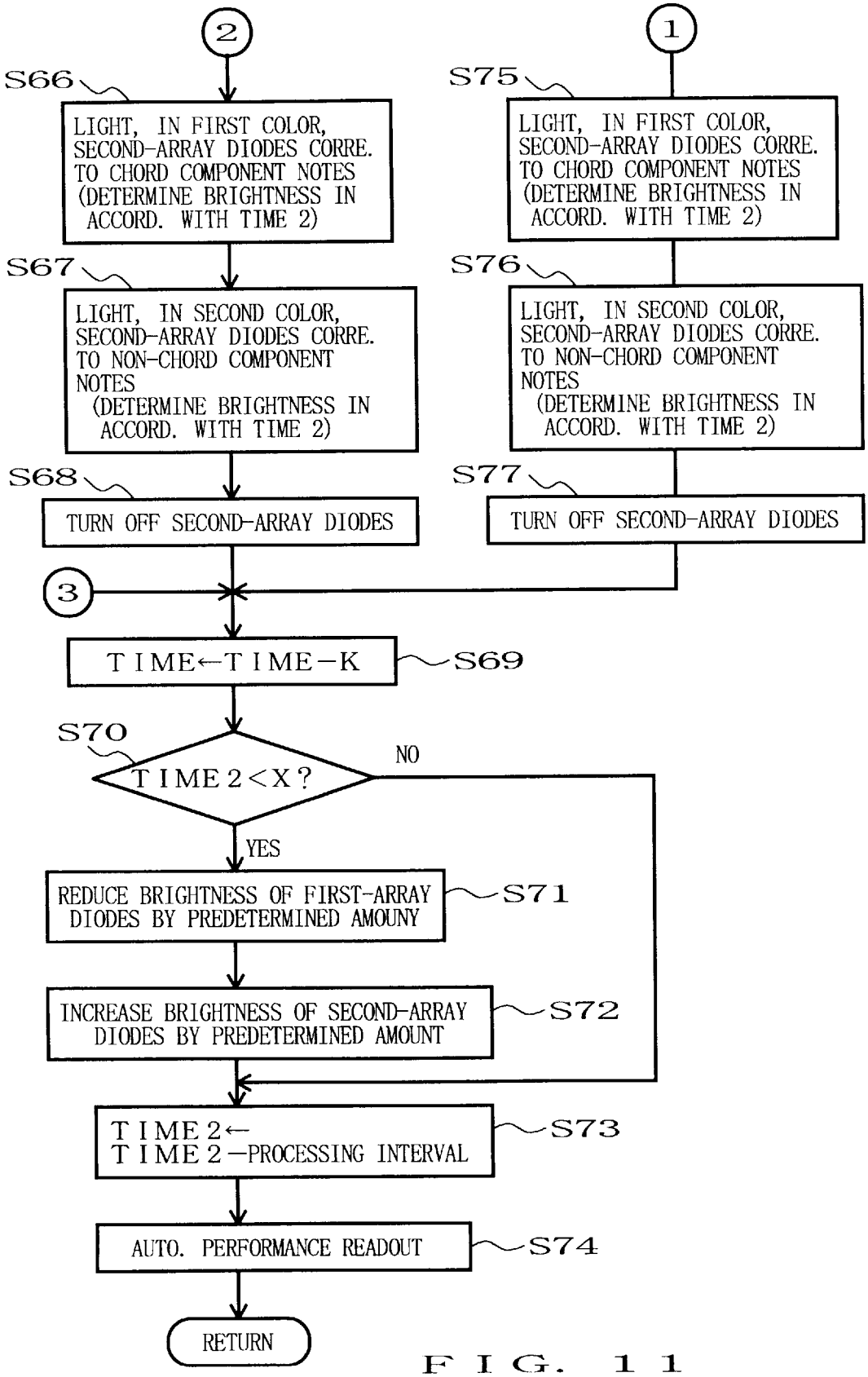
FIG. 11 is a flowchart showing the remaining portion of the modification of the interrupt process.

Then, when the automatic performance flag RUN is inverted from "0" to "1" in the automatic performance start/stop process, a data readout process as shown in FIGS. 10 and 11 is executed at predetermined intervals in place of the data readout process described earlier in relation to FIG. 8. FIGS. 10 and 11 are flowcharts illustrating portions of the data readout process which are connected at points denoted by circled reference numerals "12", "2" and "3".

First, in FIG. 10, a determination is made, at step S51, as to whether the data readout process has been started for the first time since the automatic performance flag RUN changed to the value "1". An affirmative determination results at an initial stage, so that control proceeds to step S52 and executes operations of steps S52 to S54 similar to those of steps S32 to S34 of FIG. 8 irrespective of whether the number of clock pulse TIME is "0" or not.

After that, control goes to step S55 to determine whether or not the number of clock TIME is equal to or smaller than a value "0". At an initial stage, a negative determination results at step S55 because the number of clock pulse TIME remains set, by the automatic performance start/stop process, to the number designated by the timing data of the first chord section which is greater than "0", so that control branches to step S75 of FIG. 11. At step S75, of the second-array light emitting diodes for the keys corresponding to the tone pitches of the chord component notes determined at step S53, those of the first color (e.g., red) are turned on. Also, if time TIME2 left before the initiation of the first chord section (i.e., remaining time TIME2) is below than a predetermined value X, the brightness of the above-mentioned first-color light emitting diodes is set to be a relatively low value depending on the remaining time TIME2.

The remaining time TIME2 is calculated from $$TIME2=TIME\times 60{,}000/\ tempo\times note\ resolution$$

The value "X" may be set to any desired value (e.g., one second); alternatively, the value "X" may be set to a relatively small value when the tempo is fast, while it may be set to a relatively great value when the tempo is slow.

At next step S76, of the second-array light emitting diodes for the keys corresponding to the tone pitches of the available non-chord component notes determined at step S54, those of the first color (e.g., green) are turned on. Also, if time TIME2 left before the initiation of the first chord section is below the predetermined value X, the brightness of the above-mentioned second-color light emitting diodes is set to be a relatively low value depending on the remaining time TIME2.

Following step S77 turns off all the light emitting diodes in the second array LED2 other than those previously turned on at steps S75 and S76. Then, control proceeds to step S69.

If, on the other hand, the number of clock pulse TIME indicated by timing data of the first first chord section is "0", an affirmative determination results at step S55 of FIG. 10, so that control proceeds to step S56 in order to read out from the RAM 4 timing data of a next chord section (at an initial stage, the second chord section). At next step S57, the number of clock pulse indicated by the timing data is added to the current number of clock pulse TIME, and the resultant sum is set as a new number of clock pulse TIME. Then, step S58 calculates new remaining time TIME2 corresponding to the new number of clock pulse TIME having been set at step S57.

At next step S59, it is again determined whether the data readout process has been started for the first time since the automatic performance flag RUN changed to the value "1". At an initial stage, an affirmative determination results at step S59 and control proceeds to step S60. At step S60, of the first-array light emitting diodes for the keys corresponding to the tone pitches of the chord component notes determined at step S53, those of the first color are turned on. Also, if time TIME2 left before the initiation of the chord section is below the predetermined value X, the brightness of the above-mentioned first-color light emitting diodes is set to be a relatively high value depending on the remaining time TIME2.

At next step S61, of the first-array light emitting diodes for the keys corresponding to the tone pitches of the chord component notes determined at step S54, those of the second color are turned on. Also, if time TIME2 left before the initiation of the chord section is below the predetermined value X, the brightness of the above-mentioned second-color light emitting diodes is set to be a relatively high value depending on the remaining time TIME2. Following step S62 turns off all the light emitting diodes in the first array LED1 other than those previously turned on at steps S60 and S61.

Then, tone pitches of chord component notes and available non-chord notes of that next chord section are determined by executing operations of steps S63 to S65 similar to those of steps S32 to S34 of FIG. 8.

At following step S66 of FIG. 11, of the second-array light emitting diodes for the keys corresponding to the tone pitches of the chord component notes determined at step S64, those of the first color are turned on. Also, if the remaining time TIME2 is below the predetermined value X, the brightness of the above-mentioned first-color light emitting diodes is set to be a relatively high value depending on the remaining time TIME2.

At next step S67, of the second-array light emitting diodes for the keys corresponding to the tone pitches of the available non-chord component notes determined at step S65, those of the second color are turned on. Also, if time TIME2 left before the initiation of the first chord section is below the predetermined value X, the brightness of the above-mentioned second-color light emitting diodes is set to be a relatively high value depending on the remaining time TIME2.

Following step S68 turns off all the light emitting diodes in the second array LED2 other than those previously turned on at steps S66 and S67. Then, control proceeds to step S69, where the number of clock pulse K corresponding to the processing interval of the data readout process is subtracted from the current number of clock pulse TIME, and the subtraction result is set as a new number of clock pulse TIME. At following step S70, a determination is made as to whether the remaining time TIME2 is below the predetermined value X. If answered in the negative, control jumps to step S73, where a time value obtained by subtracting the processing interval of the data readout process from the remaining time TIME2 is set as new remaining time TIME2. Then, control returns to the main routine after executing an operation of step S74 similar to that of step S42 of FIG. 8.

If, on the other hand, the remaining time TIME2 is below the predetermined value X as determined at step S70 (YES), control proceeds to step S71, where the brightness of the currently-lit light emitting diodes in the first array LED1 is reduced by a predetermined amount (however, in case a negative determination is yielded at step S55, this means that each individual light emitting diode in the first array LED1 still remains unlit, and step S71 has no significance). At next step S72, the brightness of the currently-lit light emitting diodes in the second array LED2 is increased by a predetermined amount. Then, control returns to the main routine after executing the above-mentioned operations of steps S73 and S74.

Once a next execution of the data readout process has taken place, a negative determination is yielded at step S51 of FIG. 10, so that control branches to step S78 in order to determine whether the number of clock pulse TIME is equal to or smaller than "0". If the number of clock pulse TIME is still greater than "0", a negative determination is yielded so that control jumps to step S69 of FIG. 11 to execute the above-described operations of steps S69 to S74. Thus, after the remaining time TIME2 becomes below the predetermined value X, the brightness of the currently-lit light emitting diodes in the first array LED1 is reduced by the predetermined amount, while the brightness of the currently-lit light emitting diodes in the second array LED2 is increased by the predetermined amount.

Figure 12A:
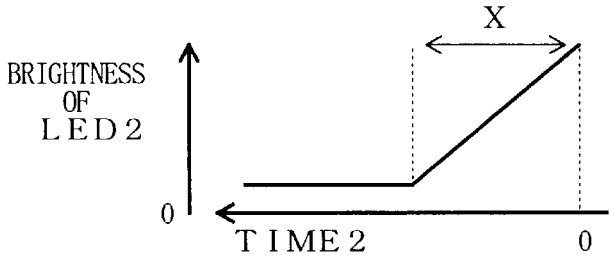
FIGS. 12A and 12B are graphs showing exemplary relationships between a remaining time and brightness of light emitting diodes in first and second arrays.
Figure 12B:
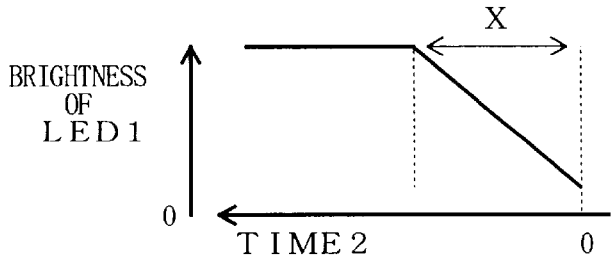

FIGS. 12A and 12B are graphs showing exemplary relationships between the remaining time TIME2 and the brightness of the light emitting diodes in the first and second arrays LED1 and LED2. In the illustrated example of FIG. 12A, the brightness of the second-array light emitting diodes LED2 is set in such a manner that it's value is the greatest when the remaining time TIME2 is equal to or greater than the predetermined value X but linearly increases as the time TIME2 decreases after the time TIME2 becomes below the value X. In the illustrated example of FIG. 12B, the brightness of the first-array light emitting diodes LED1 is set in such a manner that it's value is the smallest when the remaining time TIME2 is equal to or greater than the predetermined value X but linearly decreases as the time TIME2 decreases after the time TIME2 becomes below the value X. Alternatively, after the time TIME2 becomes below the value X, the brightness of the second-array light emitting diodes LED2 and first-array light emitting diodes LED1 may be set to non-linearly increase and decreases, respectively, as the time TIME2 decreases. In these cases, it is desired that the rate of the increase and decrease in the brightness may be set to be re;actively high when the tempo is fast but set to be relatively low when the tempo is slow.

By the above-described operations, when the timing data of the first chord section indicates a value greater than "0", the second-array light emitting diodes, for the keys corresponding to tone pitches always available for the chord section and keys corresponding to tone pitches temporarily available for the chord section are turned on or lit in red and green. Thus, by referring to the operating states of the light emitting diodes in the second array LED2, the player can know in advance the always available and temporarily available tone pitches and other tone pitches in the chord section. Thus, the player is allowed to promptly and accurately select tone pitches when the performance of the first chord section is started. Further, because the brightness of the light emitting diodes is caused to change depending on a time left before the initiation of the first chord section, the player is allowed to readily recognize the initiation timing of the chord section at a first glance. This greatly contributes to an even more prompt tone pitch selection when the first chord section is started.

On the other hand, when the timing data of the first chord section indicates "0", the first-array light emitting diodes, for the keys corresponding to tone pitches always available and temporarily available for the chord section, are turned on or lit in red and green with such brightness depending on a time left before the performance shifts to a next chord section. At the same time, the second-array light emitting diodes, for the keys corresponding to tone pitches always available and temporarily available for the next chord section, are turned on or lit in red and green with such brightness depending on a time left before the performance shifts to the next chord section. Thus, the player can readily or at a glance distinguish among the always available and temporarily available tone pitches and other tone pitches in the chord section by referring to the operating states of the first-array light emitting diodes, and can also can know in advance the always available and temporarily available tone pitches and other tone pitches in the next chord section before shifting to the next chord section by referring to the operating states of the second-array light emitting diodes. Thus, the player is allowed to promptly and accurately select tone pitches when the performance of the next chord section is started. Further, because the brightness of the light emitting diodes is caused to change depending on a time left before the initiation of the first chord section, the player is allowed to readily recognize the initiation timing of the next chord section at a first glance. This greatly contributes to an even more prompt selection of tone pitches when the next chord section is started.

Once the number of clock pulse TIME has become "0" or less after executions of the data readout process (i.e., the performance has shifted to a new chord section), an affirmative determination is yielded at step S78 via step S51 of FIG. 10, so that control proceeds to step S79. At step S79, the light emitting diodes in the first array are turned on in such a manner that the lighting state of the individual second-array light emitting diodes is exactly reflected in the first-array light emitting diodes. After this, all the light emitting diodes in the second array LED2 are turned off.

Then, control proceeds to step S56 to execute the above-described operations of steps S56 to S58. This time, a negative determination results at step S59 so that control jumps to step S63 in order to execute the above-described operations of steps S63 to S74, so that a visual display for the new chord section is made via some of the second-array light emitting diodes.

By the operations of steps S79, S56 to S59 and S63 to S74, the light emitting diodes in the first array LED1 provide a visual display for every current chord section and the light emitting diodes in the second array LED2 provide a visual display for every chord section following the current chord section. Thus, during a performance, the player can judge tone pitches conforming to the current and next chords with utmost ease.

By repetition of the data readout process, each time the performance shifts to a new chord section, the light emitting diodes in the first array LED1 provide a visual display for the new or current chord section and the light emitting diodes in the second array LED2 provide a visual display for a next chord section.

According to the present modified embodiment, the light emitting diodes for the keys corresponding to always available and temporarily available tone pitches may be intermittently lit or blinked at intervals (ratios between the lit and unlit times) varied in accordance with the remaining time LED2, rather than the brightness of these light emitting diodes being varied in accordance with the remaining time LED2. Further, as in the data readout process of FIG. 8, the brightness of the light emitting diodes for the keys corresponding to always available and temporarily available tone pitches may be allowed to differ among the diodes depending on the frequency of use of tone pitches in automatic performance data in each chord section.

Further, according to the present modified embodiment, the second-array light emitting diodes for each of the keys may be in two colors different from those of the first-array light emitting diodes. As another modification, either the first-array light emitting diodes or the second-array light emitting diodes may be blinked rather than continuously lit, or the maximum and minimum brightness of the first-array light emitting diodes may be different from those of the second-array light emitting diodes (see FIG. 12). By so doing, it is possible to minimize the possibility of the player confusing the visual display for a current chord section with that for a next chord section, to thereby achieve an even more accurate selection of tone pitches.

Also, according to the present modified embodiment, if the remaining time TIME2 before shifting to a new chord section is above a given value, the light emitting diodes in the second array LED2 may be lit only after the remaining time TIME2 reaches the given value.

Furthermore, in the present modified embodiment, three or more arrays, rather than just two arrays, of light emitting diodes may be provided so that one of the arrays is used to give a visual display for a current chord section and the other two or three arrays are used to give a visual display for two or three chord sections succeeding the current chord section.

Moreover, in the above-described embodiments of the present invention, the "available note scale tables" are prestored in the ROM 5 and available tone pitches are determined by reference to any of the tables; alternatively, available tone pitches may be determined in accordance with a predetermined algorithm based on the musical theory.

Furthermore, automatic performance data described in relation to the embodiments of the present invention comprise tone pitch information, tone generation controlling information and timing information, and data designating a musical key and chord progression are obtained from the automatic performance data and directly used for an automatic performance. Alternatively, such obtained data may be used after being modified as desired by the player. Data designating a musical key and chord progression may be embedded in the automatic performance data (i.e., prestored in accordance with a progression of a performance) for readout during the performance. As another modification, data designating chords and available note scale for use in each of the chords may be embedded in the automatic performance data. Or, the automatic performance data may be formed as pattern data for a predetermined number of measures in such a manner that the pattern data are reproduced in a repeated manner and a musical key and chord progression are designated by the player depressing keys within a predetermined chord designating key range on the keyboard 8 and activating predetermined switches on the operation panel 7 during a performance.

Furthermore, the embodiments of the present invention have been described above as lighting, in two different colors, the light emitting diodes for the keys corresponding to tone pitches of always available consonances and the light emitting diodes for the keys corresponding to tone pitches of temporarily available passing tones, but as not lighting the light emitting diodes for the keys corresponding to tone pitches of non-available dissonances. As an alternative, three light emitting diodes, each of a different color, may be provided in corresponding relation to each of the keys, so as to light, in three different colors, the light emitting diodes for the keys corresponding to tone pitches of non-available dissonances, always available consonances and temporarily available passing tones.

Moreover, whereas the embodiments of the present invention have been described above as lighting, in a uniform manner, the light emitting diodes for tone pitches of tension and non-tension notes of temporarily available passing tones, these diodes may be lit in different forms (different colors or brightness).

Also, the embodiments of the present invention have been described above as allowing the player to execute an adlib performance in combination with an automatic performance based on readout of automatic performance data, but the player may execute an adlib performance in combination with a live performance by another player.

In addition, while the embodiments of the present invention have been described above using light emitting diodes as visual display elements, any other display elements than the light emitting diodes may be employed as long as they are visually recognizable by the player.

By prestoring the operating program in a hard disk 50 rather than in the ROM 5 and loading the operating program into the RAM 4 in the arrangement of FIG. 1, the CPU 1 can operate in exactly the same way as where the operating program is stored in the ROM 5. This feature greatly facilitates version-up of the operating program, addition of a new operating program, etc. In the hard disk 50, there may be stored various other data than the operating program, such as waveform data corresponding to individual tone colors, automatic performance data and chord progression data. A CD-ROM (compact disk) 51 may be used as a removably-attachable external recording medium for recording various data such as automatic performance data, chord progression data and tone waveform data and an optional operating program, as mentioned above. Such an operating program and data stored in the CD-ROM 51 can be read out by a CD-ROM drive 52 to be then transferred for storage in the hard disk 50. This facilitates installation and version-up of the operating program. The external recording medium for storing the operating program may be other than the CD-ROM, such as a floppy disk and magneto optical disk (MO).

A communication interface 53 may be connected to the bus 56 so that the electronic musical instrument 20 can be connected via the interface 53 to a communication network 54 such as a LAN (local area network), internet and telephone line network and can also be connected to an appropriate sever computer 55 via the communication network 54. Thus, in a situation where the operating program and various data are not contained in the hard disk 50, these operating program and data can be received from the server computer 55 and downloaded into the hard disk 50. In such a case, the electronic musical instrument 20, as a "client", sends a command requesting the server computer 55 to download the operating program and various data by way of the communication interface 53 and communication network 54. In response to the command, the server computer 55 delivers the requested operating program and data to the electronic musical instrument 20 via the communication network 54. The electronic musical instrument 20, in turn, completes the necessary downloading by receiving the operating program and data via the communication network 54 and storing these into the hard disk 50.

It should also be understood here that the electronic musical instrument 20 may be implemented by installing the operating program and various data corresponding to the present invention in a commercially available personal computer. In such a case, the operating program and various data corresponding to the present invention may be provided to users in a recorded form on a recording medium, such as a CD-ROM or floppy disk, which is readable by the personal computer. Where the personal computer is connected to a communication network such as a LAN, the operating program and various data may be supplied to the personal computer via the communication network similarly to the above-mentioned.

Of course, the characteristic control of the present invention may be implemented by use of dedicated hardware circuitry as well as by execution of a software program as in the above-described embodiment.

Note that whereas the present invention has been described above as being applied to an electronic musical instrument, such as an electronic piano, provided with a keyboard, it may also be applied to electronic musical instruments provided with any other performance operator means than a keyboard.

It should also be noted that the term "electronic musical instrument" as used in relation to the present invention should be comprehensively interpreted to refer to not only apparatuses, such as keyboard-type electronic musical instruments, having performance operating members and functioning as dedicated musical instruments, but also other apparatuses, such as automatic performance devices like sequencers, tone generator modules and karaoke devices, having no performance operating members but functioning as dedicated musical instruments or information processors. The term "electronic musical instrument" should also be interpreted as referring to other apparatuses which do not always function as dedicated musical instruments or information processors but can virtually function as dedicated musical instruments or information processors depending on necessary program settings, such as the ones that can virtually function as dedicated musical instruments by running necessary tone generating and/or tone information processing programs on a general-purpose computer such as a personal computer or a multi-function game computer.

Further, it should be appreciated that the term "performance operating members" are used, in relation to the present invention, to refer to operating devices and equipment activated by the hand, feet or body of the player for performance of musical notes. Such operating devices and equipment include musical note input devices and equipment in all possible types of electric/electronic musical instrument, such as keys of keyboard-type electric/electronic musical instruments, combinations of strings and string-depressed-position detecting member of string-type electric/electronic musical instruments (such as guitars and synthesizers) and keys of wind-type electric/electronic musical instruments. Of course, examples of the performance operating members include touch screen panels which show a drawing of a keyboard to allow a user to touch desired keys so as to enter or perform musical notes. In addition, the term "keys" for performing musical notes used in relation to the present invention should also be interpreted as broadly as the term "performance operating members". Namely, the term "keys" used herein should be interpreted to include not only commonly-known keys of keyboards and wind instruments, but also combinations of strings and string-depressed-position detecting member of string-type electric/electronic musical instruments and any other arrangements to be operated for entry of desired notes.

The present invention arranged in the above-mentioned manner affords a variety of benefits as follows.

The first embodiment of the music performance assisting system allows the player to readily or at a glance distinguish among always available and temporarily available tone pitches and other tone pitches for a designated chord section. As a result, the player is allowed to execute an adlib performance with tone pitches well conforming to the designated chord, such as by mainly selecting and performing the always available tone pitches and promptly getting back to these keys if the player has selected a temporarily available tone pitch.

The second embodiment of the music performance assisting system allows the player to recognize at a glance the frequency of use of tone pitches, whether among always available tone pitches or temporarily available tone pitches, in an automatic performance. Thus, by intentionally selecting the less-frequently used tone pitches more often, it is possible to achieve an even more sophisticated adlib performance with good musical balance.

If, in the first and second embodiments of the music performance assisting system, a plurality of arrays or groups of visual display units are provided in corresponding relations to the individual performance operating members and control is performed such that one of the visual display unit arrays gives a visual display of a chord designated for a current chord section and the one or more other visual display unit arrays give a visual display of a chord designated for the following chord section, the player can select tone pitches suitable for the currently designated chord on the basis of the display form of the one visual display unit array and also know in advance tone pitches suitable for the following chord section on the basis of the display forms of the other visual display unit arrays. As a result, the player is allowed to promptly and accurately select tone pitches when the performance moves to a next chord section.

Further, in the case where a plurality of arrays or groups of the visual display units are provided, if the form of display is controlled to be different among the arrays, it is possible to minimize the possibility of the player confusing the visual display for a current chord section with that for a next chord section, to thereby achieve an even more accurate selection of tone pitches.

Furthermore, in the case where a plurality of arrays or groups of the visual display units are provided, if additional control is performed to the light emitting diodes is caused to change depending on a time left before the initiation of the first chord section, the player is allowed to readily recognize the initiation timing of the next chord section at a first glance. This greatly contributes to an even more prompt selection of tone pitches when the next chord section is started.

Moreover, in such a case where a plurality of arrays or groups of the display units are provided, each of the display unit arrays may be further controlled to give a display for a chord section following the chord section for which the display has so far been effected. Thus, even when the chord section shifting occurs, the positional relationship can be fixed between the display units of one array giving a display for the current chord section and the display units of another array giving a display for the following chord section, so that the player can judge tone pitches conforming to the current and next chords with utmost ease.

What is claimed is:

1. A music performance assisting system comprising:

a performance operator section including a plurality of performance operating members corresponding to different tone pitches;

a display section including a plurality of display units corresponding to said performance operating members;

a chord designation section which designates a chord varying with a desired chord progression;

a determination section which determines, in response to the chord designated by said chord designation section, at least two groups of tone pitches, one group that are always available for the chord and another group that are temporarily available for the chord, respectively; and a display control section which performs control to allow respective forms of display of said display units to differ from each other, depending on whether or not said performance operating members corresponding to said display units correspond to one of the two groups of tone pitches determined by said determination section and which one of the two groups of tone pitches said performance operating members correspond to.

2. A music performance assisting system as claimed in claim 1 wherein said determination section includes a table containing, for each of a plurality of chords, group information which represents one or more tone pitches belonging to one of said groups, and a readout device which reads out said group information from said table in response to the chord designated by said chord designation section.

3. A music performance assisting system as claimed in claim 1 wherein said display section includes a plurality of groups of said display units corresponding to said performance operating members, and wherein said display control section performs said control on one of the groups of said display units in correspondence with a current chord designated by said chord designation section and performs said control on other said group of said display units in correspondence with a next chord which is designated by said chord designation section after the current chord.

4. A music performance assisting system as claimed in claim 3 wherein said display control section performs further control to allow the form of display to differ between the one group of said display units and the other group of said display units.

5. A music performance assisting system as claimed in claim 3 wherein said display control section performs further control to vary the form of display of at least one of the groups of said display units in accordance with a progression of time.

6. A music performance assisting system as claimed in claim 3 wherein each time the chord designated by said chord designation section varys from one to another, said display control section performs further control to allow a fixed one of the groups of said display units to always give a display for a current chord and the other groups of the display units to always give a display for a next chord.

7. A music performance assisting system as claimed in claim 1 wherein said display control section performs further control to allow the respective forms of display of said display units to differ from each other, depending on a time left before the chord designated by said chord designation section varys from a current one to a next one.

8. A music performance assisting system as claimed in claim 1 wherein each of said display units comprises a plurality of light emitting elements of different colors, and said display control section performs control to allow said light emitting elements to differ from each other in at least one of color, brightness and blinking intervals.

9. A music performance assisting system as claimed in claim 1 which further comprises:

a performance data supply section which supplies performance data including note information designating tone pitches of tones to be generated in correspondence with the chord progression, and a detection section which detects respective frequencies of use of tone pitches designated by the note information supplied by said supply section for each chord period when one chord is designated by said chord designation section, and wherein said display control section performs further control to allow respective forms of display of said display units corresponding to the tone pitches of the same group to differ from each other, in accordance with the frequencies of use detected by said detection section.

10. A music performance assisting system as claimed in claim 9 wherein said display control section performs further control to vary the form of display of each said display unit corresponding to said performance operating member for which the form of display has been allowed to differ in accordance with the frequency of use, depending on how many times said performance operating member is operated.

11. A music performance assisting system comprising:

a performance operator section including a plurality of performance operating members corresponding to different tone pitches;

a display section including a plurality of display units corresponding to said performance operating members;

a musical key designation section which designates a desired musical key;

a chord designation section which designates a chord varying with a desired chord progression;

a determination section which determines, in response to the chord designated by said chord designation section, and depending on which one of major and minor musical keys the musical key designated by said musical key designation section is, at least two groups of tone pitches, one group that are always available for the chord and another group that are temporarily available for the chord, respectively; and a display control section which performs control to allow respective forms of display of said display units to differ from each other, depending on whether or not said performance operating members corresponding to said display units correspond to one of the two groups of tone pitches determined by said determination section and which one of the two groups of tone pitches said performance operating members correspond to.

12. A music performance assisting system as claimed in claim 11 wherein said determination section includes a table containing, for each of major and minor musical keys and for each of a plurality of chords, group information which represents one or more tone pitches belonging to one of said groups, and readout device which reads out said group information from said table in response to the musical key designated by said musical key designation section and the chord designated by said chord designation section.

13. A music performance assisting system comprising:

a performance operator section including a plurality of performance operating members corresponding to different tone pitches;

a display section including a plurality of display units corresponding to said performance operating members;

a supply section which supplies automatic performance information containing at least chord information for designating a chord varying with a predetermined chord progression;

a determination section which determines, in response to the chord designated by said chord information, at least two groups of tone pitches, one group that are always available for the chord and another group that are temporarily available for the chord, respectively;

a detection section which detects respective frequencies of use of tone pitches in the automatic performance information supplied by said supply section for each chord period when one chord is designated by said chord information; and a display control section which performs control to allow respective forms of display of said display units to differ from each other, depending on whether or not said performance operating members corresponding to said display units correspond to one of the two groups of tone pitches and which one of the two groups of tone pitches said performance operating members correspond to, and also in accordance with the frequencies of use detected by said detection section for the tone pitches of the same group.

14. A music performance assisting system as claimed in claim 13 wherein said display control section performs further control to vary the form of display of each said display unit corresponding to said performance operating member for which the form of display has been allowed to differ in accordance with the frequency of use, depending on how many times said performance operating member is operated.

15. A music performance assisting system as claimed in claim 13 wherein said display section includes a plurality of groups of said display units corresponding to said performance operating members, and wherein said display control section performs said control on one of the groups of said display units in correspondence with a current chord designated by said chord designation section and performs said control on other said group of said display units in correspondence with a next chord which is designated by said chord designation section after the current chord.

16. A music performance assisting system comprising:

a performance operator section including a plurality of performance operating members corresponding to different tone pitches;

a display section including a plurality of display units corresponding to said performance operating members;

a supply section which supplies automatic performance information containing at least musical key information for designating a musical key and chord information for designating a chord varying with a predetermined chord progression;

a determination section which determines, in response to the chord designated by said chord information, and depending on which one of major and minor musical keys the musical key designated by said musical key information is, at least two groups of tone pitches, one group that are always available for the chord and another group that are temporarily available for the chord, respectively;

a detection section which detects respective frequencies of use of tone pitches in the automatic performance information supplied by said supply section for each chord section where one chord is designated by chord information; and a display control section which performs control to allow respective forms of display of said display units to differ from each other, depending on whether or not said performance operating members corresponding to said display units correspond to one of the two groups of tone pitches determined by said determination section and which one of the two groups of tone pitches said performance operating members correspond to, said display control section also allowing the forms of display of said display units corresponding to the tone pitches of the same group to differ from each other in accordance with the frequencies of use detected by the detection section.

17. A music performance assisting system as claimed in claim 16 wherein said display control section performs further control to vary the form of display of each said display unit corresponding to said performance operating member for which the form of display has been allowed to differ in accordance with the frequency of use, depending on how many times said performance operating member is operated.

18. A method of indicating a performance key to be operated for a music performance operating device including a plurality of performance keys corresponding to musical notes and display units corresponding to said performance keys, said method comprising the steps of:

receiving chord information;

for a chord designated by the received chord information, defining at least first and second groups of musical notes in such a manner that said first group contains musical notes always available for said chord and said second group contains musical notes temporarily available for said chord; and operating said display units for the performance keys, corresponding to said first and second groups of musical notes, in particular forms of display that are different between said first and second groups.

19. A method of indicating a performance key to be operated for a music performance operating device including a plurality of performance keys corresponding to musical notes and display units corresponding to said performance keys, said method comprising the steps of:

receiving automatic performance information containing chord information;

for a chord designated by the received chord information, defining at least first and second groups of musical notes in such a manner that said first group contains musical notes always available for said chord and said second group contains musical notes temporarily available for said chord;

on the basis of the automatic performance information, detecting respective frequencies of use of musical notes in a performance section corresponding to the received chord information; and operating said display units for the performance keys, corresponding to said first and second groups of musical notes, in particular forms of display that are different between first and second groups, with the forms of display of said display units corresponding to the tone pitches of the same group controlled to differ from each other in accordance with the frequencies of use detected by the detection device.

20. A machine-readable recording medium containing a group of instructions to cause said machine to implement a method of indicating a performance key to be operated in a music performance operating device including a plurality of performance keys corresponding to musical notes and display units corresponding to the performance keys, said method including the steps of:

receiving chord information;

for a chord designated by the received chord information, defining at least first and second groups of musical notes in such a manner that said first group contains musical notes always available for said chord and said second group contains musical notes temporarily available for said chord; and operating said display units for the performance keys, corresponding to said first and second groups of musical notes, in particular forms of display that are different between said first and second groups.

21. A machine-readable recording medium containing a group of instructions to cause said machine to implement a method of indicating a performance key to be operated in a music performance operating device including a plurality of performance keys corresponding to musical notes and display units corresponding to the performance keys, said method including the steps of:

receiving automatic performance information containing chord information;

for a chord designated by the received chord information, defining at least first and second groups of musical notes in such a manner that said first group contains musical notes always available for said chord and said second group contains musical notes temporarily available for said chord;

on the basis of the automatic performance information, detecting respective frequencies of use of musical notes in a performance section corresponding to the received chord information; and operating said display units for the performance keys, corresponding to said first and second groups of musical notes, in particular forms of display that are different between said first and second groups, with the forms of display of said display units corresponding to the tone pitches of the same group controlled to differ from each other in accordance with the frequencies of use detected by the detection devices.

* * * * *